US007796737B2

(12) United States Patent
Allen et al.

(10) Patent No.: US 7,796,737 B2
(45) Date of Patent: Sep. 14, 2010

(54) APPARATUS FOR REDUCING KV-DEPENDENT ARTIFACTS IN AN IMAGING SYSTEM AND METHOD OF MAKING SAME

(75) Inventors: Donald Robert Allen, Waukesha, WI (US); Brian Lounsberry, Thiensville, WI (US); James J. VanBogart, Ixonia, WI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/116,767

(22) Filed: May 7, 2008

(65) Prior Publication Data

US 2009/0279668 A1 Nov. 12, 2009

(51) Int. Cl.
*H01J 5/18* (2006.01)

(52) U.S. Cl. ..... 378/140; 378/121

(58) Field of Classification Search ..... 378/140, 378/119–144
See application file for complete search history.

(56) References Cited

U.S. PATENT DOCUMENTS

| | | | | |
|---|---|---|---|---|
| 7,042,981 | B2 | 5/2006 | Subraya et al. | |
| 7,079,624 | B1 * | 7/2006 | Miller et al. | 378/119 |
| 7,290,929 | B2 * | 11/2007 | Smith et al. | 378/193 |
| 7,410,296 | B2 * | 8/2008 | Rogers | 378/203 |
| 2004/0223588 | A1 * | 11/2004 | Subraya et al. | 378/141 |
| 2006/0050850 | A1 * | 3/2006 | Andrews et al. | 378/119 |
| 2007/0025517 | A1 * | 2/2007 | McDonald et al. | 378/140 |

* cited by examiner

*Primary Examiner*—Hoon Song
(74) *Attorney, Agent, or Firm*—Ziolkowski Patent Solutions Group, SC

(57) ABSTRACT

An x-ray tube includes a cathode positioned within a vacuum chamber and configured to emit electrons. The x-ray tube includes an anode positioned within the vacuum chamber to receive electrons emitted from the cathode and configured to generate a beam of x-rays from the electrons, a window positioned to pass the beam of x-rays therethrough, and an electron collector structure attached to the x-ray tube having an aperture formed therethrough to allow passage of x-rays therethrough. The aperture is shaped to prevent diffracted x-rays from combining with the beam of x-rays passing through the window.

26 Claims, 5 Drawing Sheets

APPARATUS FOR REDUCING KV-DEPENDENT ARTIFACTS IN AN IMAGING SYSTEM AND METHOD OF MAKING SAME

BACKGROUND OF THE INVENTION

The invention relates generally to x-ray tubes and, more particularly, to an x-ray tube constructed to address kV-dependent artifacts that result from primary beam interaction with an electron collector of the x-ray tube.

X-ray systems typically include an x-ray tube, a detector, and an assembly to support the x-ray tube and the detector. In some applications, the assembly is rotatable. In operation, an object is located between the x-ray tube and the detector. The x-ray tube typically emits radiation, such as x-rays, toward the object such that the radiation typically passes through the object to impinge on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient positioned in a medical imaging scanner and an inanimate object as in, for instance, a package in a computed tomography (CT) package scanner.

X-ray tubes typically include an anode having a high density track material, such as tungsten, that generates x-rays when high energy electrons impinge thereon. The anode structure typically includes a target cap and a heat storage unit, such as graphite, attached thereto. X-ray tubes also include a cathode that has a filament to which a high voltage is applied to provide a focused electron beam. The focused electron beam comprises electrons that emit from the filament, which is typically constructed of tungsten, and are accelerated across an anode-to-cathode vacuum gap to produce x-rays upon impact with the track material. As the electrons impinge upon the track material and rapidly decelerate, a spectrum of x-rays is generated. X-rays generated within the anode emit therefrom and pass to the detector through, typically, a low density or low atomic number material such as beryllium, which is typically referred to as a "window."

X-ray generation results in a large amount of heat being generated within the anode. Much of the energy is dissipated via conduction into the target, where it is stored in the heat storage unit and radiated to the surrounding walls from the heat storage unit. Coolant surrounding the walls transfers the heat out of the tube. However, much of the energy, including up to 40% or more, may be back-scattered from the anode to impinge upon other components within the x-ray tube. Much of this back-scatter energy is deposited in and around the window, which can overheat the window and the joints that attach the window to the x-ray tube.

An electron collector, or back-scatter electron reduction apparatus, which is typically fabricated of copper and has coolant circulated therethrough, is designed to be thermally coupled to the window and to have an aperture aligned with the window to allow passage of electrons therethrough. Accordingly, the coolant removes the heat load from the window and the surrounding region, thus maintaining the window and its attachment joints at low temperatures during operation of the x-ray tube.

However, the electron collector typically includes a substantial amount of mass and volume in order to both sink the heat and house the coolant lines therein. Thus, the walls of the aperture typically have a substantial depth, such as a few centimeters or more. And, because the x-rays emit from the focal spot in all directions, some of the x-rays impinge upon the walls of the aperture. The material of the electron collector is typically a polycrystalline material such as copper having, therefore, a large grain structure in a number of crystal orientations. Thus, interaction of the x-ray beam with the walls of the aperture can result in lattice diffraction (i.e., Bragg diffraction), and if the incident beam strikes a crystal at the Bragg angle relative to a diffracting plane, a portion of the incident beam will be redirected from its original vector. The Bragg diffraction condition for $1^{st}$ order diffraction is given as $L=2*d*\sin(T)$, where L is the x-ray wavelength, d is the spacing between crystalline planes, and T is the diffraction angle. The diffracted beam will therefore result in an area of locally increased intensity that, when impacting on the detector, may give rise to an area of increased intensity, resulting in an image artifact.

A rotating anode x-ray tube generates a polychromatic spectrum of x-radiation. If the accelerating potential is below the K-edge of the anode track material, a Bremsstrahlung spectrum is generated. However, if the accelerating potential exceeds the K-edge for the track material, then characteristic radiation is also generated. The characteristic x-ray peaks increase dramatically in intensity relative to the Bremsstrahlung radiation as the tube accelerating potential is increased above the K-edge energy. In contrast, the intensity of the Bremsstrahlung increases gradually with increasing potential. Therefore, if x-rays of characteristic wavelength cause diffraction from the aperture, an image artifact can be generated that worsens as the accelerating potential increases above the K-edge energy, and any image artifact created cannot be easily calibrated out of the system due to the strong dependence on tube accelerating potential.

Therefore, it would be desirable to design a system and apparatus to reduce diffraction of x-rays within an electron collector of an x-ray tube without compromising the thermal performance of the electron collector.

BRIEF DESCRIPTION OF THE INVENTION

The invention provides a method and apparatus for reducing kV dependent image artifacts in an x-ray tube.

According to one aspect of the invention, an x-ray tube includes a cathode positioned within a vacuum chamber and configured to emit electrons. The x-ray tube also includes an anode positioned within the vacuum chamber to receive electrons emitted from the cathode and configured to generate a beam of x-rays from the electrons, a window positioned to pass the beam of x-rays therethrough, and an electron collector structure attached to the x-ray tube having an aperture formed therethrough to allow passage of x-rays therethrough. The aperture is shaped to prevent diffracted x-rays from combining with the beam of x-rays passing through the window.

In accordance with another aspect of the invention, a method of manufacturing an x-ray tube includes the steps of positioning a cathode in a vacuum chamber and positioning an anode within the vacuum chamber to receive electrons emitted from the cathode and generate a beam of x-rays. The method further includes positioning a window proximate to the anode to receive the beam of x-rays emitted from the anode, and attaching an electron collector structure to the x-ray tube, the electron collector having an aperture therein that is positioned to allow passage of the beam of x-rays through the window.

Yet another aspect of the invention includes an x-ray system that includes an x-ray tube positioned to emit the x-rays toward an object. The x-ray tube includes an anode positioned to generate the x-rays from electrons that impinge thereon, and a window material positioned to receive the x-rays. The x-ray tube also includes an electron collector structure attached to the x-ray tube and having an opening therein, the opening positioned to allow passage of the x-rays therethrough, and an attenuating material attached to the electron collector structure.

Various other features and advantages of the invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
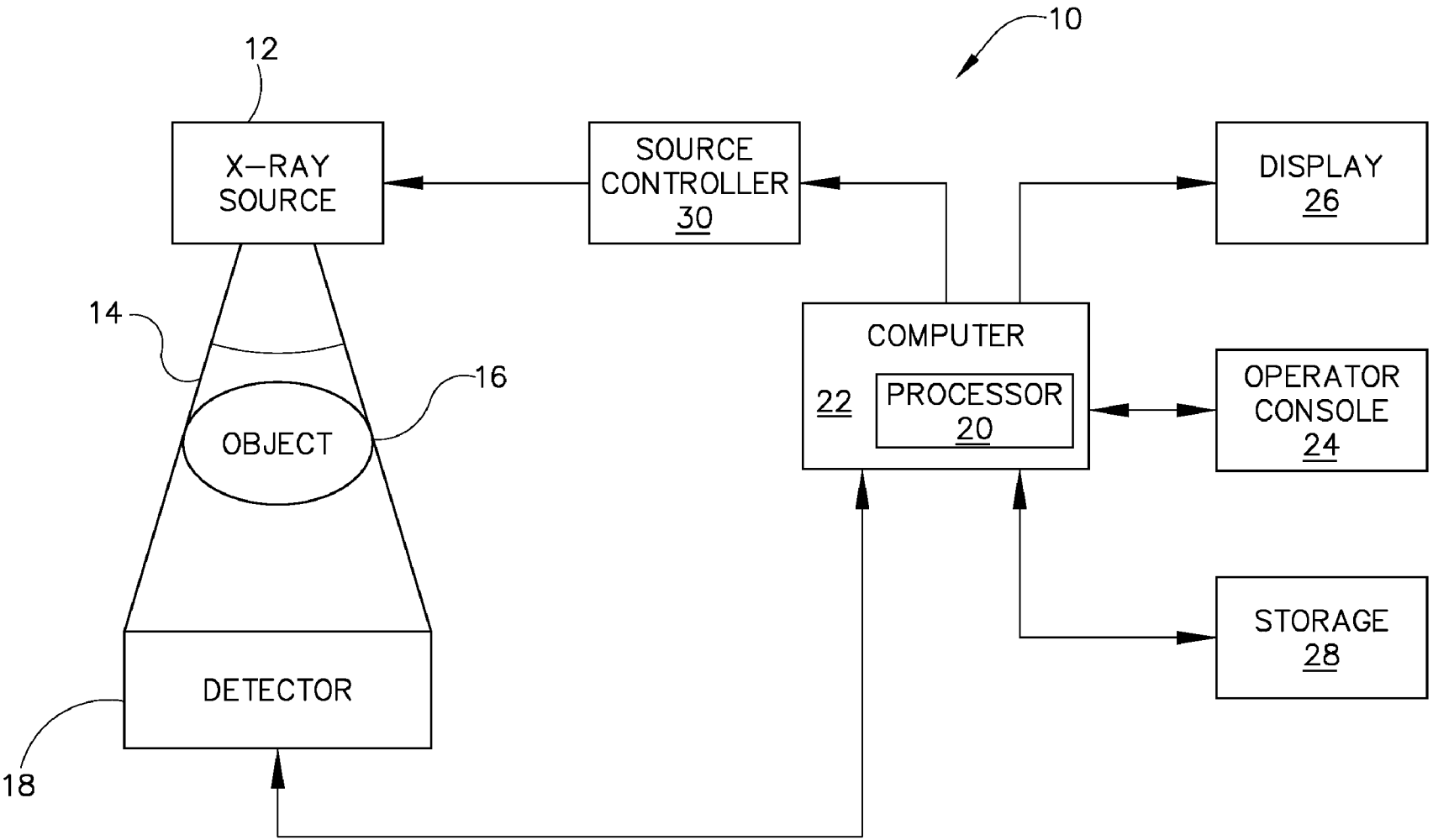
FIG. 1 is a block diagram of an imaging system that can benefit from incorporation of an embodiment of the invention.

FIG. 1 is a block diagram of an embodiment of an imaging system 10 designed both to acquire original image data and to process the image data for display and/or analysis in accordance with the invention. It will be appreciated by those skilled in the art that the invention is applicable to numerous medical imaging systems implementing an x-ray tube, such as x-ray or mammography systems. Other imaging systems such as computed tomography (CT) systems and digital radiography (RAD) systems, which acquire image three dimensional data for a volume, also benefit from the invention. The following discussion of x-ray system 10 is merely an example of one such implementation and is not intended to be limiting in terms of modality.

As shown in FIG. 1, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays 14 pass through object 16 and, after being attenuated by the object, impinge upon a detector 18. Each detector in detector 18 produces an analog electrical signal that represents the intensity of an impinging x-ray beam, and hence the attenuated beam, as it passes through the object 16. In one embodiment, detector 18 is a scintillation based detector, however, it is also envisioned that direct-conversion type detectors (e.g., CZT detectors, etc.) may also be implemented.

A processor 20 receives the analog electrical signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, floppy discs, compact discs, etc. The operator may also use console 24 to provide commands and instructions to computer 22 for controlling a source controller 30 that provides power and timing signals to x-ray source 12.

Figure 2:
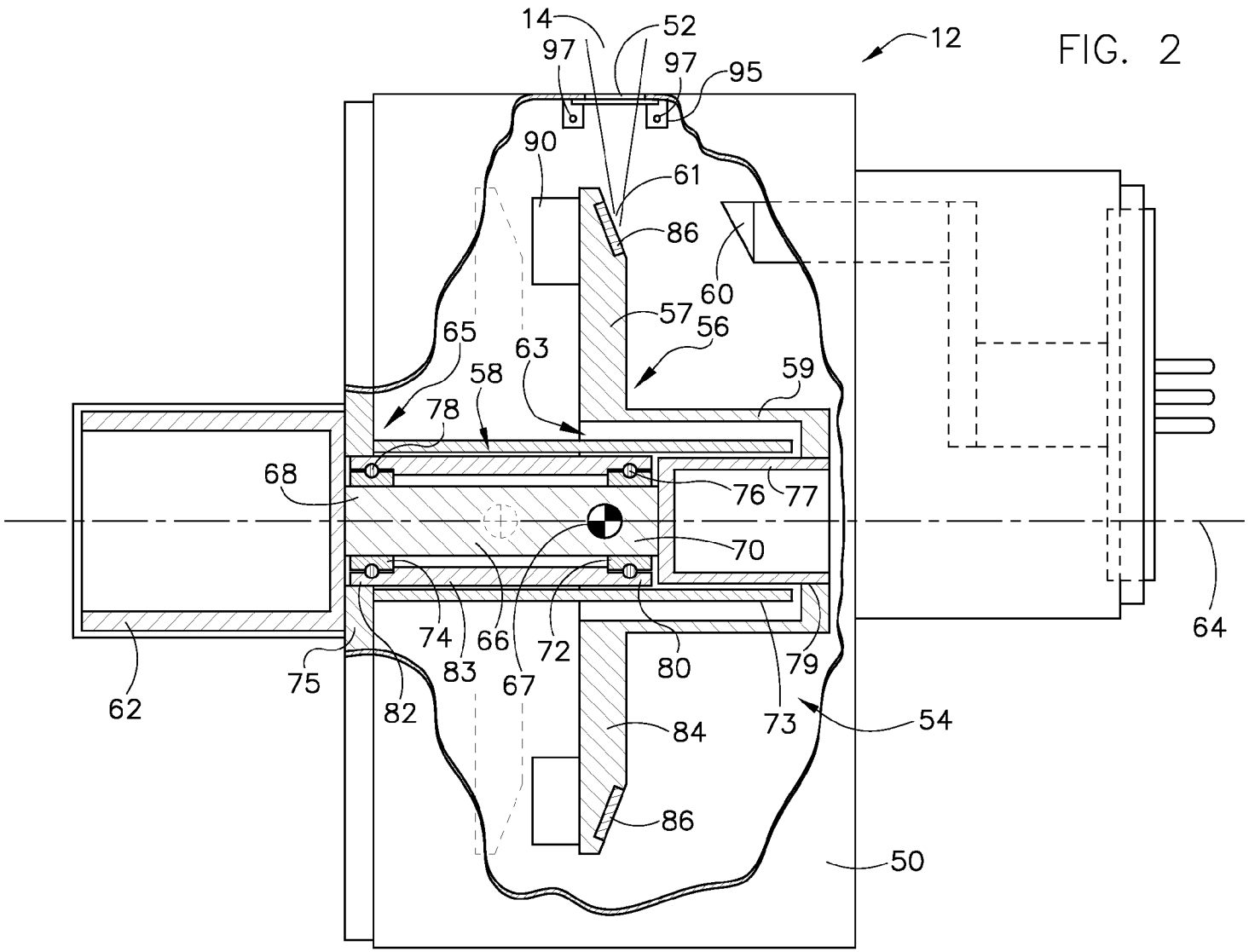
FIG. 2 is a cross-sectional view of an x-ray tube according to an embodiment of the invention and useable with the system illustrated in FIG. 1.

FIG. 2 illustrates a cross-sectional view of an x-ray tube insert 12 incorporating an embodiment of the invention. The x-ray tube insert 12 includes a vacuum chamber or frame 50 typically positioned within a casing (not shown). The frame 50 has a radiation emission passage 52 formed therein that may be referred to as a window, or window material. The frame 50 encloses a vacuum 54 and houses an anode 56, a bearing cartridge 58, a cathode 60, and a rotor 62. The anode 56 includes a target 57 having a target shaft 59 attached thereto. X-rays 14 are produced when high-speed electrons are decelerated when directed from the cathode 60 to the target 57 via a potential difference therebetween of, for example, 60 thousand volts or more in the case of CT applications. Operation may be bipolar (kV applied to both the cathode and the anode) or monopolar (kV applied to one of the cathode or the anode and having, for instance, an anode grounded operation). The electrons impact a target track material 86 at focal point 61 and a primary beam of x-rays 14 emit therefrom. The x-rays 14 emit through the radiation emission passage 52 toward a detector array, such as detector 18 of FIG. 1. To avoid overheating the target track material 86 from the electrons, the anode 56 is rotated at a high rate of speed about a centerline 64 at, for example, 90-250 Hz.

The bearing cartridge 58 includes a front bearing assembly 63 and a rear bearing assembly 65. The bearing cartridge 58 further includes a center shaft 66 attached to the rotor 62 at a first end 68 of center shaft 66, and a bearing hub 77 attached at a second end 70 of center shaft 66. The front bearing assembly 63 includes a front inner race 72, a front outer race 80, and a plurality of front balls 76 that rollingly engage the front races 72, 80. The rear bearing assembly 65 includes a rear inner race 74, a rear outer race 82, and a plurality of rear balls 78 that rollingly engage the rear races 74, 82. Bearing cartridge 58 includes a stem 83 which is supported by a back plate 75. A stator (not shown) is positioned radially external to rotor 62, which rotationally drives anode 56. The target shaft 59 is attached to the bearing hub 77 at joint 79. One skilled in the art will recognize that target shaft 59 may be attached to the bearing hub 77 with other attachment means, such as a bolted joint, a braze joint, a weld joint, and the like. In one embodiment a receptor 73 is positioned to surround the stem 83 and is attached to the x-ray tube 12 at the back plate 75. The receptor 73 extents into a gap formed between the target shaft 59 and the bearing hub 77.

Referring still to FIG. 2, the target 57 includes a target substrate 84, having target track material 86 attached thereto. The target track material 86 typically includes tungsten or an alloy of tungsten, and the target substrate 84 typically includes molybdenum or an alloy of molybdenum. A heat storage medium 90, such as graphite, may be used to sink and/or dissipate heat built-up near the focal point 61. One skilled in the art will recognize that the target track material 86 and the target substrate 84 may comprise the same material, which is known in the art as an all metal target.

The anode 56 has a re-entrant target design that serves to position the mass or center-of-gravity 67 of target 57 at a position between the front bearing assembly 63 and the rear bearing assembly 65 and substantially along centerline 64, about which center shaft 66 rotates. Additionally, both target shaft 59 and bearing hub 77 serve to increase a conduction path length between target 57 and bearing cartridge 58 such that a reduction in the peak operating temperature of front inner race 72, front balls 76, and front outer race 80 may be realized as compared to a direct connection of target 57 to second end 70 of center shaft 66. In one embodiment, as illustrated in phantom in FIG. 2, the center-of-gravity 67 of the target 57 is positioned equidistant between the front bearing assembly 63 and the rear bearing assembly 65. As such, the mechanical load of the target 57 is positioned between the two bearing assemblies 63, 65, thus causing the two bearing assemblies 63, 65 to wear at approximately equal rates. One skilled in the art will recognize that the positioning of target 57 in a re-entrant target design as illustrated also results in a combined center-of-gravity of target 57, target shaft 59, bearing hub 77, center shaft 66, and rotor 62 positioned between the front bearing assembly 63 and the rear bearing assembly 65. The distance of re-entrance of target 57 may be designed such that the combined center-of-gravity may be positioned equidistant between front bearing assembly 63 and rear bearing assembly 65 to cause two bearing assemblies 63, 65 to wear at approximately equal rates.

In operation, as electrons impact focal point 61 and produce x-rays 14, heat generated therein causes the target 57 to increase in temperature, thus causing the heat to transfer via radiation heat transfer to surrounding components such as, and primarily, casing 50. Heat generated in target 57 also transfers conductively through target shaft 59 and bearing hub 77 to bearing cartridge 58 as well, leading to an increase in temperature of bearing cartridge 58. The heat generated includes radiant thermal energy from the anode 56 and kinetic energy of back-scattered electrons that deflect off of the anode 56. The back-scattered electrons typically impinge upon an electron collector 95 positioned on and typically attached to the radiation emission passage 52. As such, back-scattered electrons that would otherwise impinge on the radiation emission passage 52, are intercepted by the electron collector 95. The electron collector 95 may include coolant lines 97 which carry coolant therethrough and reduce the operating temperature of the electron collector 95.

Figure 3:
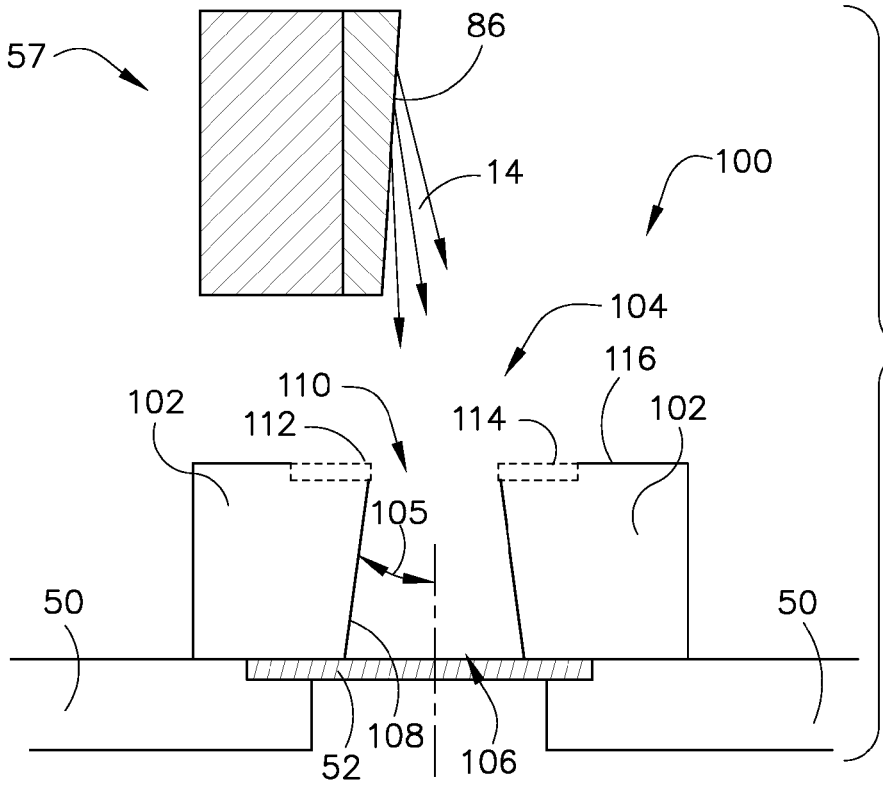
FIG. 3 is an illustration of an electron collector having a truncated cone shape according to an embodiment of the invention.
Figure 4:
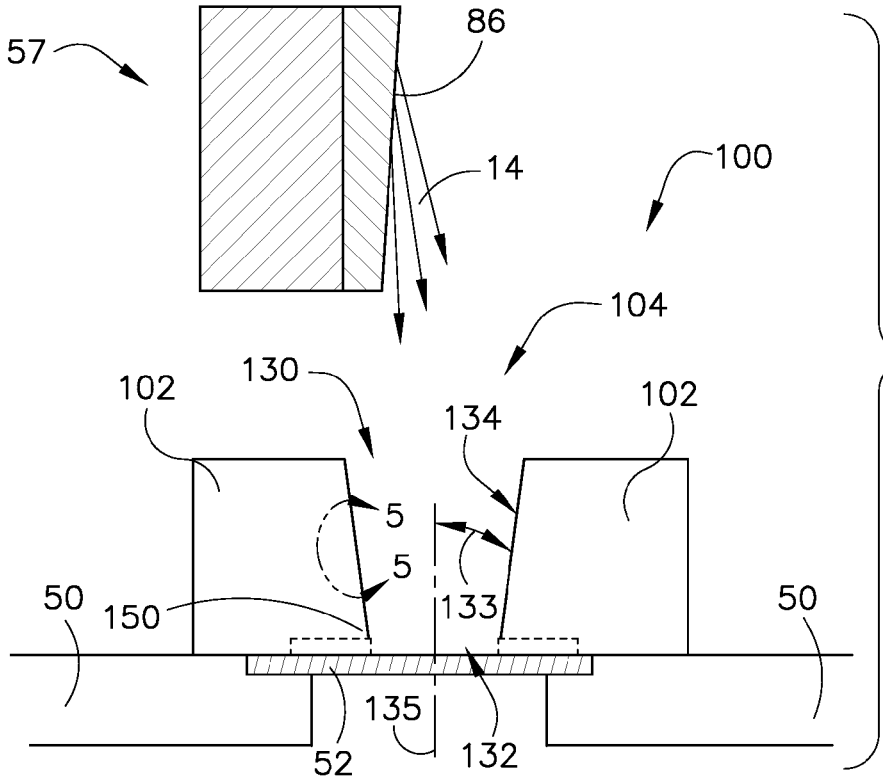
FIG. 4 is an illustration of an electron collector having a truncated cone shape according to an embodiment of the invention.

FIGS. 3-4 illustrate an electron collector 100 according to embodiments of the invention. In the disclosed embodiments, the electron collector 100 comprises a material 102, such as copper, that is attached to the radiation emission passage 52 and frame 50 as illustrated in FIG. 2. The electron collector 100 includes an aperture 104 that is positioned to allow passage of x-rays 14 that are emitted from the target track material 86 of target 57, as illustrated in FIG. 2. One skilled in the art will recognize that the electron collector 100 may be attached to the radiation emission passage 52, the frame 50, or both.

For Bragg diffraction, as is known in the art, the deviation of x-rays from an incident beam is 2× the Bragg angle (θ). In other words, incoming x-rays at the Bragg angle are diffracted from the lattice at the Bragg angle, hence the x-rays are re-directed by 2× the Bragg angle. Bragg diffraction is dependent on both 1) the material on which the diffraction occurs (i.e. its lattice structure), and 2) the type of radiation generated at the anode. As such, the configuration of aperture 104 may be selected based on at least the electron collector material 102 (i.e. copper) and the target track material 86 of target 57. Table 1 below summarizes results for Bragg diffraction in copper, where the most intense reflection is the (111) reflection, and for characteristic radiation of W, Mo, and Rh. Table 1 includes 2× the Bragg angle for a copper collector with respect to x-rays of the primary beam of x-rays.

TABLE 1

| radiation | 2(θ) (°) |
|---|---|
| W Kα | 5.75 |
| Mo Kα | 19.6 |
| Rh Kα | 16.9 |

As such, and referring to Table 1, because the track material 86 may include, as examples, W, Mo, and Rh, various types of characteristic radiation may be generated therein that, therefore, have differing Bragg angles against a copper collector. Furthermore, the primary beam of electrons, having a high energy, may penetrate below the surface of the collector and generate Bragg diffraction therein, which, if not attenuated in the collector, may emerge from the collector after being reflected by 2× the Bragg angle and cause image artifacts.

Referring now to FIG. 3, according to an embodiment of the invention, an electron collector 100 includes an opening or aperture 104 shaped as a truncated cone, or conical frustrum, having an angle 105 selected to minimize or reduce image artifacts resulting from Bragg diffraction. According to this embodiment, aperture 104 is shaped having both a largest (i.e., base) diameter 106 and a smallest (i.e., top) diameter 110, and having space therebetween defined by a wall 108 of electron collector 100. The angle 105 of wall 108 and other geometric aspects of the electron collector 100, including the position of a top surface 116 and corner 112, is selected such that x-rays 14 of the primary beam pass through aperture 104 free from interaction with wall 108 of aperture 104. In other words, the angle 105 of the aperture 104 is selected such that any x-rays emanating from the target track material 86 that impinge upon the top surface 116 do not pass to the wall 108 because the wall 108 is "shadowed" by the corner 112. Furthermore, one skilled in the art will recognize that implementation of this embodiment includes accounting for thermal growth of components such that x-rays 14 emanating from the target track material 86 toward electron collector 100 are intercepted by the top surface 116 of the electron collector 100 throughout all operating temperatures and conditions of the x-ray source 12.

One skilled in the art will recognize that x-rays passing through the corner 112 may not be collected by electron collector 100 and may diffract at the Bragg angle within the collector material 102 to pass into the aperture 104, though the emission passage 52, and impinge on a detector such as, for instance, the detector 18 of FIG. 1. As such, an attenuating material 114 may be positioned on or embedded within surface 116 of the electron collector 100. The attenuating material 114 is positioned to attenuate any x-rays 14 impinging thereon such that the x-rays are fully attenuated by the attenuating material 114 and/or the collector material 102 underneath. Thus, the thickness of attenuating material 114 is selected based on both the type of radiation generated at the target track 86 and the type of attenuating material 114. Table 2 below summarizes material thicknesses, in mm, for different attenuating materials 114 and radiation type, such that approximately 99% of x-rays are attenuated by the attenuating material 114.

TABLE 2

| radiation | attenuating material | | |
|---|---|---|---|
| | W | Au | Mo |
| W Kα | 0.011 | 0.031 | 0.345 |
| Mo Kα | 0.036 | 0.030 | 0.056 |
| Rh Kα | 0.643 | 0.527 | 1.056 |

According to embodiments of the invention, the attenuating material 114 may include silver, gold, platinum, tungsten, and the like (and their alloys). Other materials that may be used for the attenuating material 114 may include, for example, hafnium, iridium, molybdenum, niobium, osmium, palladium, rhenium, rhodium, tantalum, etc. (and their alloys). The attenuating material 114 may be applied by plating and other deposition processes known within the art. Alternatively, one skilled in the art will recognize that the attenuating material 114 may be brazed, soldered, welded, or mechanically fastened to the aperture according to methods known within the art.

For the attenuating material thicknesses of Table 2 that are less than, for instance, 0.100 mm, one skilled in the art will recognize that the attenuating material 114 may be applied using a variety of deposition processes such as plasma vapor deposition (PVD) and chemical vapor deposition (CVD). Likewise, for attenuating material thicknesses that are greater than 0.100 mm, the attenuating material 114 may be an insert or attached piece that may be joined by brazing, soldering, welding, or mechanically fastening, as examples.

Instead of precluding x-rays from impinging upon the wall 108, as described with respect to the embodiment illustrated in FIG. 3, the electron collector 102 may instead be designed to absorb diffracted x-rays that impinge upon the wall within the material of the collector 102, according to an embodiment of the invention. Referring now to FIG. 4, the aperture 104 is shaped as a truncated cone or a conical frustrum having a wall angle, illustrated by reference 133, selected to minimize or reduce image artifacts resulting from Bragg diffraction. In this embodiment, the truncated cone aperture 104 has a base or largest diameter 130, a top or smallest diameter 132, and a wall 134 therebetween formed about a central axis 135 of the aperture 104. The two aperture diameters 130, 132 are selected such that wall angle 133 is achieved. Wall angle 133 is determined to be greater than the Bragg angle (i.e., 133>θ) such that any x-ray 14 emitting from target 57 and impinging on the wall 134 at the Bragg angle (θ, with respect to the lattice orientation) are diffracted into the collector material 102. Such diffraction is illustrated in FIG. 5.

Figure 5:
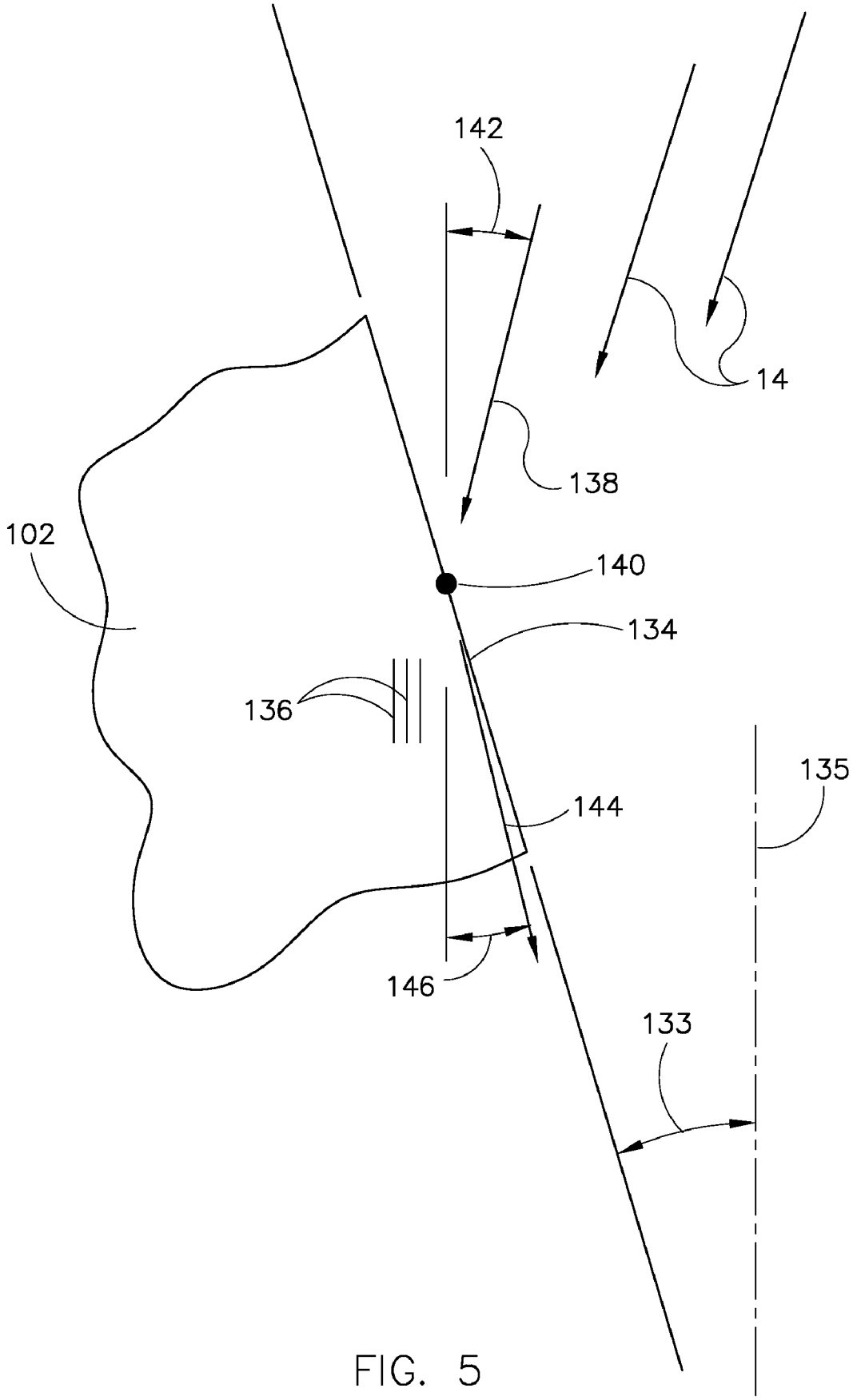
FIG. 5 is an illustration of an angled wall and x-rays deflected therefrom according to an embodiment of the invention.

Referring now to FIG. 5, a portion of electron collector 100 of FIG. 4 along line 5-5 is shown. According to the embodiment shown in FIG. 5, the collector material 102 is formed of copper having a (111) lattice orientation or structure 136 as illustrated. As described above with respect to FIG. 4, the electron collector 100 includes a wall 134 having a wall angle 133 about central axis 135. X-rays 14 may include a plurality of x-rays 14 that includes an x-ray 138 that impinges on the wall 134 at, for example, an impingement point 140 and having an angular orientation with respect to the lattice structure 136 at the Bragg angle (θ), illustrated by reference number 142. Being at the Bragg angle with respect to the lattice structure 136, the x-ray 138 may be deflected, or diffracted to a new vector 144 at, likewise, the Bragg angle (θ), illustrated by reference number 146. Because the Bragg angle (θ) is shallower or less than wall angle 133, the x-rays diffracted at the new vector 144 may, in this example, be diffracted into the collector material 102 and attenuated therein.

As described above, wall angle 133 is determined such that x-rays 14 that impinge the wall 134 at the Bragg angle (θ) are deflected into the aperture material 102. The deflected x-rays are, accordingly, absorbed or attenuated in the aperture material 102 after deflecting therefrom at the Bragg angle (θ). One skilled in the art will recognize that the wall angle 133 may be selected based on at least the characteristic radiation, the collector material, and the geometric relation of the target 57 with respect to the collector 102 such that substantially all x-rays diffracted in the electron collector 102 are diffracted into the collector 102, as illustrated in FIG. 5.

Referring again to FIG. 4, x-rays 14 that impinge upon the aperture material 102 at or near a corner 150 may be deflected into the material 102 as described above. However, because the corner 150 is proximate the emission passage 52, such deflected x-rays may not be fully absorbed or may be minimally absorbed by the aperture material 102, and may instead pass through the emission passage 52. Such x-rays may cause image artifacts when received in a detector such as, for instance, the detector 18 of the imaging system 10. As such, an attenuating layer 152 may be positioned proximate the corner 150 of the aperture 104 and between the aperture material 102 and the emission passage 52. Because the deflected x-rays near the corner 150 may be minimally deflected, the characteristics necessary to attenuate them may be similar to those described with respect to Table 2 and with respect to the embodiment illustrated in FIG. 3. Thus, like the embodiment described with respect to FIG. 3, one skilled in the art will recognize that the thickness of attenuating material 152 is selected based on both the type of radiation and the type of attenuating material 152.

Furthermore, one skilled in the art will recognize that the embodiments described herein are applicable to a wide range of design conditions related to an x-ray tube and its operation. As stated above, wall angle 133 is determined to be greater than the Bragg angle such that any x-rays 14 emitting from target 57 and impinging on the wall 134 at the Bragg angle are diffracted into the collector material 102. One skilled in the art will recognize that the x-rays 14 that impinge upon the wall 134 may have a widely varying and complex range of angles, and such angles are affected by a number of geometric and operating parameters of the x-ray source 12. Such parameters include, but are not limited to, the radial length of the target track material 86, the radial position of the target track material 86 with respect to the position of the electron collector 100, the characteristic radiation generated at the target track material 86, and the lattice orientation of the electron collector material 102 with respect to the central axis 135 of the aperture 104.

Furthermore, one skilled in the art will recognize that the position of the target 57 with respect to the electron collector 100 may change due to thermal growth of components within the x-ray tube 12 during operation, or due to physical deformation of the x-ray tube as it ages. For instance, one skilled in the art will recognize that the bearing cartridge 58 of FIG. 2 may operate at a temperature well in excess of its assembly temperature. As such, during operation when the bearing cartridge 58 and other components increase in temperature, the anode 56 may shift toward the cathode 60, thus resulting in an axial shift in the position of the target track material 86. Such an axial shift may result in x-rays deflecting off of the aperture, through the emission passage 52, and to the detector 18 of FIG. 1, such that image artifacts may be generated therein. Accordingly, one skilled in the art will recognize that the angle 133 may be selected or determined to ensure that deflected x-rays are absorbed in either the aperture material 102 or the attenuating material 152, or both, over the above-described wide-ranging designs and operating conditions.

Figure 6:
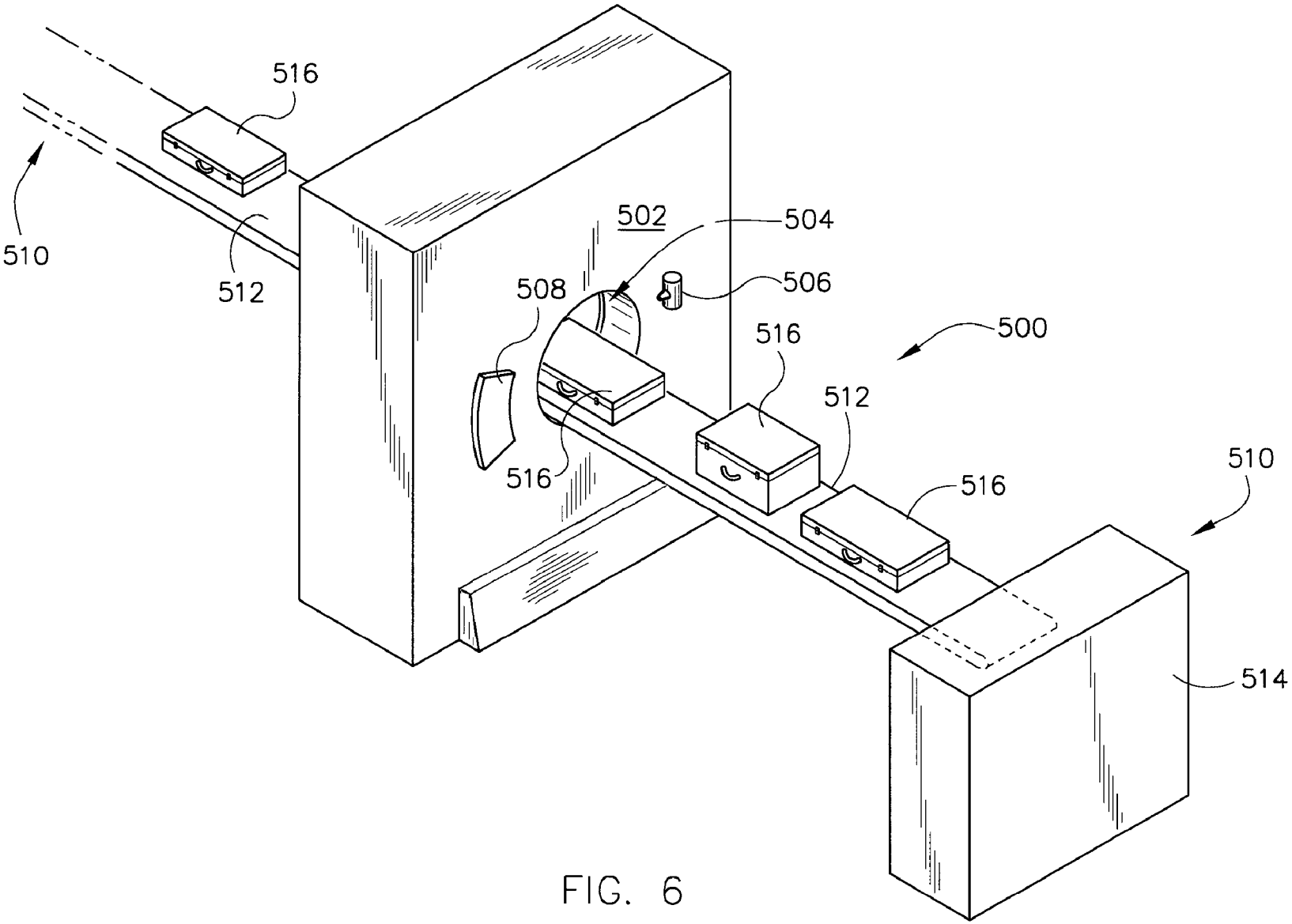
FIG. 6 is a pictorial view of an x-ray system for use with a non-invasive package inspection system that can benefit from incorporation of an embodiment of the invention.

FIG. 6 is a pictorial view of an x-ray system 500 for use with a non-invasive package inspection system. The x-ray system 500 includes a gantry 502 having an opening 504 therein through which packages or pieces of baggage may pass. The gantry 502 houses a high frequency electromagnetic energy source, such as an x-ray tube 506, and a detector assembly 508. A conveyor system 510 is also provided and includes a conveyor belt 512 supported by structure 514 to automatically and continuously pass packages or baggage pieces 516 through opening 504 to be scanned. Objects 516 are fed through opening 504 by conveyor belt 512, imaging data is then acquired, and the conveyor belt 512 removes the packages 516 from opening 504 in a controlled and continuous manner. As a result, postal inspectors, baggage handlers, and other security personnel may non-invasively inspect the contents of packages 516 for explosives, knives, guns, contraband, etc. One skilled in the art will recognize that gantry 502 may be stationary or rotatable. In the case of a rotatable gantry 502, system 500 may be configured to operate as a CT system for baggage scanning or other industrial or medical applications.

Therefore, according to one embodiment of the invention, an x-ray tube includes a cathode positioned within a vacuum chamber and configured to emit electrons. The x-ray tube also includes an anode positioned within the vacuum chamber to receive electrons emitted from the cathode and configured to generate a beam of x-rays from the electrons, a window positioned to pass the beam of x-rays therethrough, and an electron collector structure attached to the x-ray tube having an aperture formed therethrough to allow passage of x-rays therethrough. The aperture is shaped to prevent diffracted x-rays from combining with the beam of x-rays passing through the window.

In accordance with another embodiment of the invention, a method of manufacturing an x-ray tube includes the steps of positioning a cathode in a vacuum chamber and positioning an anode within the vacuum chamber to receive electrons emitted from the cathode and generate a beam of x-rays. The method further includes positioning a window proximate to the anode to receive the beam of x-rays emitted from the anode, and attaching an electron collector structure to the x-ray tube, the electron collector having an aperture therein that is positioned to allow passage of the beam of x-rays through the window.

Yet another embodiment of the invention includes an x-ray system that includes an x-ray tube positioned to emit the x-rays toward an object. The x-ray tube includes an anode positioned to generate the x-rays from electrons that impinge thereon, and a window material positioned to receive the x-rays. The x-ray tube also includes an electron collector structure attached to the x-ray tube and having an opening therein, the opening positioned to allow passage of the x-rays therethrough, and an attenuating material attached to the electron collector structure.

The invention has been described in terms of the preferred embodiment, and it is recognized that equivalents, alternatives, and modifications, aside from those expressly stated, are possible and within the scope of the appending claims.

What is claimed is:

1. An x-ray tube comprising:

a cathode positioned within a vacuum chamber and configured to emit electrons;

an anode positioned within the vacuum chamber to receive electrons emitted from the cathode and configured to generate a beam of x-rays from the electrons;

a window positioned to pass the beam of x-rays therethrough; and an electron collector structure attached to the x-ray tube having a conical aperture formed therethrough to allow passage of the beam of x-rays therethrough toward the window;

wherein the conical aperture includes a first opening and a second opening, wherein the first opening is positioned closer to the anode than the second opening, and wherein one of the first and second openings is larger than the other of the first and second openings.

2. The x-ray tube of claim 1 wherein the first opening is larger than the second opening.

3. The x-ray tube of claim 2 further comprising an attenuating material applied to the electron collector structure proximate to the second opening.

4. The x-ray tube of claim 3 wherein the attenuating material is applied to the electron collector structure by one of a plating and a deposition process.

5. The x-ray tube of claim 3 wherein the attenuating material is applied to the electron collector structure by one of brazing, soldering, welding, and mechanical fastening.

6. The x-ray tube of claim 1 wherein the conical aperture includes an angled sidewall that is configured such that deflected x-rays that contact the angled sidewalls deflect into the electron collector structure.

7. The x-ray tube of claim 1 wherein the conical aperture includes curvy sidewalls.

8. The x-ray tube of claim 1 wherein the second opening is larger than the first opening.

9. The x-ray tube of claim 8 further comprising an attenuating material applied to the electron collector structure proximate to the first opening.

10. The x-ray tube of claim 9 wherein the attenuating material is applied to the electron collector structure by one of a plating and a deposition process.

11. The x-ray tube of claim 9 wherein the attenuating material is applied to the electron collector structure by one of brazing, soldering, welding, and mechanical fastening.

12. The x-ray tube of claim 1 wherein the x-ray tube is a monopolar x-ray tube.

13. The x-ray tube of claim 1 wherein the x-ray tube is a bi-polar x-ray tube.

14. A method of manufacturing an x-ray tube comprising the steps of:

positioning a cathode in a vacuum chamber;

positioning an anode within the vacuum chamber to receive electrons emitted from the cathode and generate a beam of x-rays;

positioning a window proximate to the anode to receive the beam of x-rays emitted from the anode;

forming an electron collector;

selecting a desired wall angle based on a Bragg angle of a material of the electron collector;

forming an aperture in the electron collector, the aperture having the desired wall angle; and attaching the electron collector to the x-ray tube, the electron collector positioned to allow passage of the beam of x-rays toward the window.

15. The method of claim 14 further comprising positioning the aperture such that the base diameter is positioned closer to the anode than the top diameter.

16. The method of claim 15 further comprising attaching an attenuating material to the electron collector structure on a sidewall of the electron collector structure adjacent to the window.

17. The method of claim 14 further comprising positioning the aperture such that the top diameter is positioned closer to the anode than the base diameter.

18. The method of claim 17 further comprising attaching an attenuating material to the electron collector structure on a sidewall of the electron collector structure adjacent to the anode.

19. An x-ray system comprising:

an x-ray tube positioned to emit x rays toward an object, the x-ray tube comprising:

an anode positioned to generate the x-rays from electrons that impinge thereon;

a window material positioned to receive the x-rays;

an electron collector structure attached to the x-ray tube and having an opening shaped as a conical frustum therein, the electron collector positioned between the window material and the anode, the opening positioned to allow passage of the x-rays therethrough toward the window material; and an attenuating material attached to the electron collector structure.

20. The x-ray system of claim 19 further comprising a detector positioned to receive x-rays that pass through the object.

21. The x-ray system of claim 19 wherein the electron collector structure opening has a base diameter and a top diameter, wherein the base diameter is larger than the top diameter, and wherein the top diameter is positioned closer to the anode than the base diameter.

22. The x-ray system of claim 19 wherein the attenuating material is positioned on a surface of the electron collector structure facing the anode.

23. The x-ray system of claim 19 wherein the electron collector structure opening has a base diameter and a top diameter smaller than the base diameter, wherein the anode is positioned closer to the base diameter than the top diameter, and wherein a sidewall of the opening causes directional deflection of x-rays that impinge thereon to deflect into the electron collector structure.

24. The x-ray system of claim 23 wherein the attenuating material is positioned on a surface of the electron collector structure facing the window material.

25. An x-ray tube comprising:

a cathode positioned within a vacuum chamber and configured to emit electrons;

an anode positioned within the vacuum chamber to receive electrons emitted from the cathode and configured to generate a beam of x-rays from the electrons;

a window positioned to pass the beam of x-rays therethrough; and an electron collector structure attached to the x-ray tube having an aperture formed therethrough to allow passage of the beam of x-rays therethrough toward the window;

wherein the aperture includes a first opening and a second opening;

wherein the first opening is positioned closer to the anode than the second opening;

wherein one of the first and second openings is larger than the other of the first and second openings; and wherein the second opening is larger than the first opening.

26. A method of manufacturing an x-ray tube comprising the steps of:

positioning a cathode in a vacuum chamber;

positioning an anode within the vacuum chamber to receive electrons emitted from the cathode and generate a beam of x-rays;

positioning a window proximate to the anode to receive the beam of x-rays emitted from the anode; and attaching an electron collector structure to the x-ray tube, the electron collector having an aperture therein that is positioned to allow passage of the beam of x-rays toward the window;

positioning the aperture such that a base diameter is positioned closer to the anode than a top diameter;

attaching an attenuating material to the electron collector structure on a sidewall of the electron collector structure adjacent to the window wherein the base diameter that is greater than the top diameter.

* * * * *